United States Patent [19]

Yokoi et al.

[11] Patent Number: 4,788,731

[45] Date of Patent: Dec. 6, 1988

[54] MATTRESS

[75] Inventors: Shinji Yokoi, Okazaki; Kimitaka Naitoh, Toyohashi; Masami Ohta, Okazaki, all of Japan

[73] Assignee: Aisin Seiki Kabushiki Kaisha, Kariya City, Japan

[21] Appl. No.: 20,904

[22] Filed: Mar. 2, 1987

[30] Foreign Application Priority Data

| | | | |
|---|---|---|---|
| Feb. 28, 1986 | [JP] | Japan | 61-029783[U] |
| Apr. 15, 1986 | [JP] | Japan | 61-056557[U] |
| Apr. 23, 1986 | [JP] | Japan | 61-061353[U] |

[51] Int. Cl.[4] ..... A47C 27/04

[52] U.S. Cl. ..... 5/478; 5/475; 5/468

[58] Field of Search ..... 5/478, 468, 475

[56] References Cited

U.S. PATENT DOCUMENTS

| | | | |
|---|---|---|---|
| 1,619,916 | 3/1927 | Brewster | 5/475 |
| 1,973,651 | 9/1934 | Odets | 5/478 |
| 1,978,956 | 10/1934 | Nord | 5/468 |
| 2,296,559 | 9/1942 | Krakauer | 5/468 |
| 3,307,207 | 3/1967 | Cole | 5/478 |
| 3,325,833 | 6/1967 | Withoff | 5/478 |
| 3,512,192 | 5/1970 | Simon | 5/478 |
| 3,923,293 | 12/1975 | Wiegand | 5/478 |
| 4,357,724 | 11/1982 | Laforest | 5/478 |
| 4,463,466 | 8/1984 | May et al. | 5/478 |

FOREIGN PATENT DOCUMENTS

| | | | |
|---|---|---|---|
| 73118 | 3/1983 | European Pat. Off. | 5/478 |
| 724817 | 2/1955 | United Kingdom . | |
| 887438 | 1/1962 | United Kingdom . | |

*Primary Examiner*—Alexander Grosz

*Attorney, Agent, or Firm*—Oblon, Fisher, Spivak, McClelland & Maier

[57] ABSTRACT

In a mattress, a first wadding having numerous gaps therein is provided on one surface of a central core. Body heat of a user on the mattress and sweat emitted from him/her are given off into an inner space of the core through the gaps and are thereafter exhausted from peripheral portions of the mattress. Thus, the user may sleep comfortably in the hot season.

5 Claims, 2 Drawing Sheets

MATTRESS

BACKGROUND OF THE INVENTION

1. Field of the Invention

The present relates to a mattress, and in particular to a mattress in which waddings are provided at opposite broad surfaces of a central core.

2. Description of the Prior Art

Japanese Utility Model Application, which has been published after examination as No. 54-32663, discloses a mattress construction of this type. In the mattress construction, a plurality of coiled compression springs are connected with one another so as to constitute a rectangular core. A first pad made of vegetable fiber and a second pad made of animal fiber are provided, respectively, at one broad surface and the other broad surface of the rectangular core. During the hot season, one side of the rectangular core is oriented in the right upward direction for use due to the high hygroscopicity of the first pad. On the contrary, during the cold season, the other side of the rectangular core is oriented in the right upward direction of use due to the high heat insulating property of the second pad.

However, since first insulator made of urethane resins is disposed between one broad surface of the rectangular core and the first pad, air permeability across the first pad is not good. Thus, a user may not escape from mugginess due to poor ventilation through the first pad in spite of the good hygroscopicity thereof.

SUMMARY OF THE INVENTION

It is, therefore, an object of the present invention to provide a mattress construction.

DETAILED DESCRIPTION OF THE EMBODIMENTS

Figure 1:
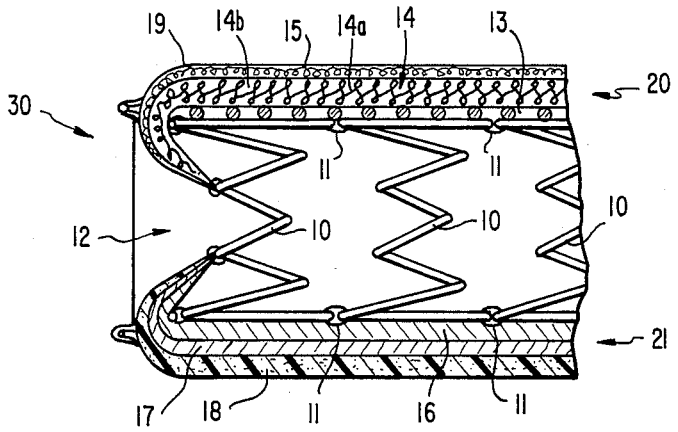
FIG. 1 is a cross-sectional view of a portion of a mattress in accordance with the present invention.

Referring now to FIG. 1, a mattress 30 includes a plurality of coiled compression springs 10 which are placed next to one another to form a rectangular central core 12. Neighbouring springs 10,10 are connected with each other by a helical wire 11. Since the core 12 itself is of a well-known construction, only a portion thereof is illustrated in FIG. 1.

On an upper surface of the core 12, there is provided a first wadding 20 including a first protector 13 in the form of a net, a first insulator 14, and a first pad 15. The first insulator 14 is formed by entangling or curling numerous filaments **14*a* each of which is in the form of a synthetic resin member or nylon with a radius of 100–600 denier. Neighbouring filaments 14*a* are connected with each other by suitable means such as heat-welding or a bonding agent. Thus, the first insulator 14 has provided therein numerous air gaps 14*b*** with mutual communication therebetween.

The first pad 15 is similar to the first insulator 14 in configuration, but the radius of each filament made from polyester is about 50 denier. Thus, the air gaps of the first pad 15 are relatively smaller than those of the first insulator 14. By setting the first pad 15 on an upper surface of the first insulator 14, the roughness thereof is not transmitted to a user M on the mattress 30.

On a lower surface of the core 12, there is provided a second wadding 21 including a second protector 16 made of felt, a second insulator 17 made of felt, and a second pad 18 made of urethane resins.

Upon enclosure or wrap of the first wadding 20 and the second wadding 21 by a cover cloth 19, the mattress 30 is ultimately or completely assembled.

Figure 2:
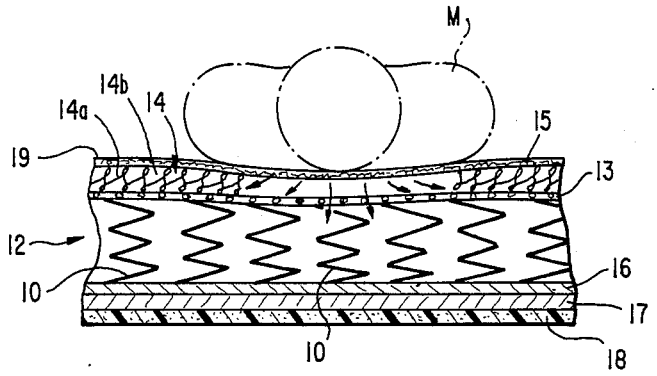
FIG. 2 is a cross-sectional view for showing function of a first wadding of the mattress upon use thereof.

As seen from FIG. 2, body heat of the user M and sweat radiated therefrom are given off in an arrowed direction due to good permeability in all directions in the first insulator 14 and are exhausted from a peripheral portion of the mattress 30. Thus, temperature and moisture at a portion on which the user M is in abutment with the upper surface of the mattress 30 may be greatly decreased, resulting in the user M's comfortable sleep in the hot season.

Figure 3:
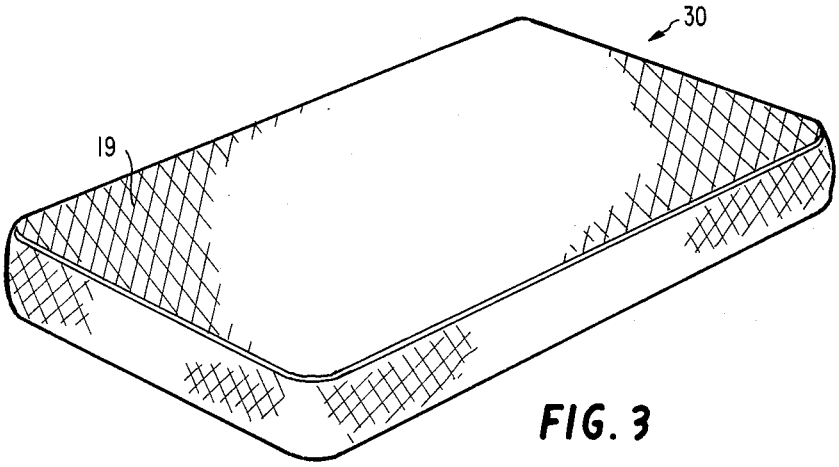
FIG. 3 is a perspective view of the mattress on which meshed cloth is provided.

For increasing the permeability of the first insulator 14, the first insulator 14 is covered with a meshed cloth as shown in FIG. 3.

Figure 4:
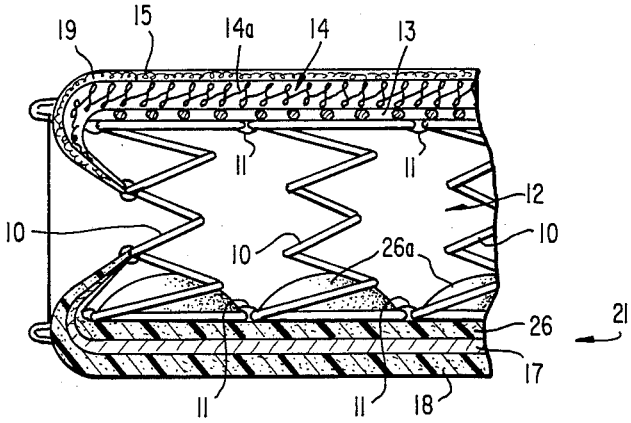
FIG. 4 is a cross-sectional view for showing an improved second wadding of the mattress.

The second protector 16 may be replaced by a new protector 26 having plural convex portions **26*a* made of cotton as shown in FIG. 4. Each convex portion 26*a*, having numerous dead air portions (not shown) therein, is in engagement with an end portion of a corresponding spring 10. Upon use of the mattress 30 in the cold season, body heat of the user M transmitted to the convex portions 26*a* is reserved in the dead air portions therein. Thus, heat leakage to an inner portion of the mattress 30** may be prevented, resulting in the user M's comfortable sleep in the cold season.

We claim:

1. A mattress comprising:

(a) a central core formed by arranging plural coiled compression springs into a rectangular shape;

(b) a first wadding provided on one surface of said central core, said first wadding having numerous air gaps therein;

(c) a second wadding provided on the other surface of said central core, said second wadding having good heat insulating properties and having plural convex portions each one of which projects into a corresponding one of said plural coiled compression springs, each one of said plural convex portions containing numerous dead air portions, said second wadding comprising a second insulator located near said central core, said second insulator containing therein numerous closed air gaps, and a second pad located exteriorly of said second insulator; and (d) an air permeable cover cloth wrapped around said first and second waddings.

2. A mattress as recited in claim 1 wherein said first wadding comprises:

(a) a first insulator located near said central core, said first insulator containing therein numerous relatively large air gaps each of which is in fluid communication with other air gaps in all directions, and (b) a first pad located exteriorly of said first insulator, said first pad containing therein numerous relatively small air gaps each of which is in fluid communication with other air gaps in all directions.

3. A mattress as recited in claim 2 wherein said first insulator comprises numerous entangled filaments of synthetic resin.

4. A mattress as recited in claim 1 wherein said second insulator is made from cotton.

5. A mattress as recited in claim 1 wherein said air permeable cover cloth comprises a mesh.

* * * * *

UNITED STATES PATENT AND TRADEMARK OFFICE

CERTIFICATE OF CORRECTION

PATENT NO. : 4,788,731

DATED : DECEMBER 6, 1988

INVENTOR(S) : SHINJI YOKOI ET AL.

It is certified that error appears in the above-identified patent and that said Letters Patent is hereby corrected as shown below:

In column 1, line 24, "However, since" insert --a-- before "first";

In column 1, line 49, delete "Neighbouring" and insert --Neighboring--;

In column 1, line 59, delete "Neighbouring" and insert --Neighboring--;

Signed and Sealed this

Sixteenth Day of May, 1989

*Attest:*

*Attesting Officer*

DONALD J. QUIGG

*Commissioner of Patents and Trademarks*